US009222290B2

(12) United States Patent
Tanaka et al.

(10) Patent No.: US 9,222,290 B2
(45) Date of Patent: Dec. 29, 2015

(54) INSIDE-DOOR-HANDLE DEVICE FOR VEHICLE

(75) Inventors: Ryoichi Tanaka, Kanagawa (JP); Noriaki Ito, Kanagawa (JP)

(73) Assignee: ALPHA CORPORATION, Yokohama-shi, Kanagawa (JP)

( * ) Notice: Subject to any disclaimer, the term of this patent is extended or adjusted under 35 U.S.C. 154(b) by 187 days.

(21) Appl. No.: 13/817,838

(22) PCT Filed: Sep. 27, 2011

(86) PCT No.: PCT/JP2011/072117

§ 371 (c)(1), (2), (4) Date: Feb. 20, 2013

(87) PCT Pub. No.: WO2012/043583

PCT Pub. Date: Apr. 5, 2012

(65) Prior Publication Data

US 2013/0140834 A1 Jun. 6, 2013

(30) Foreign Application Priority Data

Sep. 30, 2010 (JP) ..... 2010-221106

(51) Int. Cl.

*E05B 3/00* (2006.01)
*E05B 85/12* (2014.01)
*E05B 79/06* (2014.01)

(52) U.S. Cl.

CPC ..... *E05B 85/12* (2013.01); *E05B 79/06* (2013.01); *E05B 85/13* (2013.01); *Y10T 292/57* (2015.04)

(58) Field of Classification Search

USPC ..... 16/412, 413; 292/336.3, 80, 81, 87, 89, 292/DIG. 31, 347, 348, DIG. 53; 296/1.08, 296/146.1; 70/455

See application file for complete search history.

(56) References Cited

U.S. PATENT DOCUMENTS

| | | | | |
|---|---|---|---|---|
| 7,104,575 | B2 * | 9/2006 | Kakita | 292/348 |
| 8,220,848 | B2 * | 7/2012 | Minemura et al. | 292/347 |
| 8,359,712 | B2 * | 1/2013 | Saitou et al. | 16/412 |
| 8,408,611 | B2 * | 4/2013 | Takagai et al. | 292/336.3 |
| 8,727,401 | B2 * | 5/2014 | Tanaka et al. | 292/336.3 |
| 2004/0212200 | A1 * | 10/2004 | Kakita | 292/347 |
| 2010/0171325 | A1 * | 7/2010 | Takagai et al. | 292/336.3 |
| 2010/0293753 | A1 * | 11/2010 | Saitou et al. | 16/412 |
| 2013/0088022 | A1 * | 4/2013 | Collado et al. | 292/336.3 |

FOREIGN PATENT DOCUMENTS

| | | |
|---|---|---|
| CN | Y-201068685 | 6/2008 |
| CN | Y-201236535 | 5/2009 |
| JP | 2003-193708 | 7/2003 |
| JP | 2005-163291 | 6/2005 |

* cited by examiner

*Primary Examiner* — Alyson M Merlino

(74) *Attorney, Agent, or Firm* — Drinker Biddle & Reath LLP

(57) ABSTRACT

An inside-door-handle device for a vehicle is provided with a base part and a cover. A swinging space is provided between the base part and the cover. The cover has a locking section; the base part has a lock-receiving section. A swing motion of the cover relative to the base part is regulated by the elastic locking between the locking section and the lock-receiving section. If the cover swings relative to the base part due to pushing operation toward the cover, the lock between the locking section and the lock-receiving section is released, and the cover can be separated from the base part.

9 Claims, 7 Drawing Sheets

INSIDE-DOOR-HANDLE DEVICE FOR VEHICLE

TECHNICAL FIELD

The present invention relates to an inside-door-handle device for a vehicle.

BACKGROUND ART

Patent Document 1 discloses an inside-door-handle for a vehicle, in which a fixed part of the inside-door-handle to a vehicle inner panel is covered with a cover body and therefore prevented from being exposed to an outside.

PRIOR ART DOCUMENT

Patent Document

Patent Document 1: US 2004/0212200

The inside-door-handle disclosed in Patent Document 1 includes a handle base to which an operation handle is pivotally supported and a cover body which is connected to the handle base and covers a fixed part of the handle base to a door panel. The cover body is mounted to the handle base by resiliently locking a locking leg for a releasing operation formed at a side edge to the handle base. A detaching operation is performed by inserting a tool through a gap appearing on a wall surface of the handle base and a surface of the cover body and unlocking the locking leg for the releasing operation.

However, since the tool is required, a workability of the detaching operation becomes poor.

SUMMARY OF INVENTION

Embodiments of the present invention provide an inside-door-handle device for a vehicle which is capable of improving a detaching operability of a cover body.

In accordance with embodiments of the present invention, an inside-door-handle device for a vehicle may include a base part BP and a cover body 3 which is removably connected to the base part BP and which covers a connection section 13 of the base part BP to a door-side in a cover body 3 mounted-position where the cover body 3 is mounted to the base part BP. A swinging space 8 may be provided between the base part BP and the cover body 3 in the mounted position. The cover body 3 may have a locking part 4, the base part BP may have a locked part 5 and the swinging of the cover body 3 relative to the base part BP may be restricted by a resilient locking of the locking part 4 and the locked part 5 so that the cover body 3 is held in the mounted position. An inclined surface part 6 may be formed on at least one of the locking part 4 and the locked part 5. A force in an unlocking direction may be generated by the inclined part 6 when the cover body 3 is swung relative to the base part BP by a pushing operation of the cover body 3 and therefore the locking of the locking part 4 and the locked part 5 may be released, so that the cover body 3 can be detached from the base part BP.

BRIEF DESCRIPTION OF DRAWINGS

FIG. 4(*b*) is a view as seen in a direction of an arrow 4B in FIG. 4(*a*). FIG. 4(*c*) is a view as seen in a direction of an arrow 4C-4C in FIG. 4(*a*).

FIG. 5(*a*) shows a mounting operation. FIG. 5(*b*) shows a completely mounted state. FIG. 5(*c*) shows a state where a side edge of the cover body is pushed down. FIG. 5(*d*) shows a state where the locking of the cover body is released.

FIG. 6(*a*) is a view corresponding to FIG. 2(*a*). FIG. 6(*b*) is a view corresponding to FIG. 2(*b*).

DESCRIPTION OF EMBODIMENTS

Figure 1:
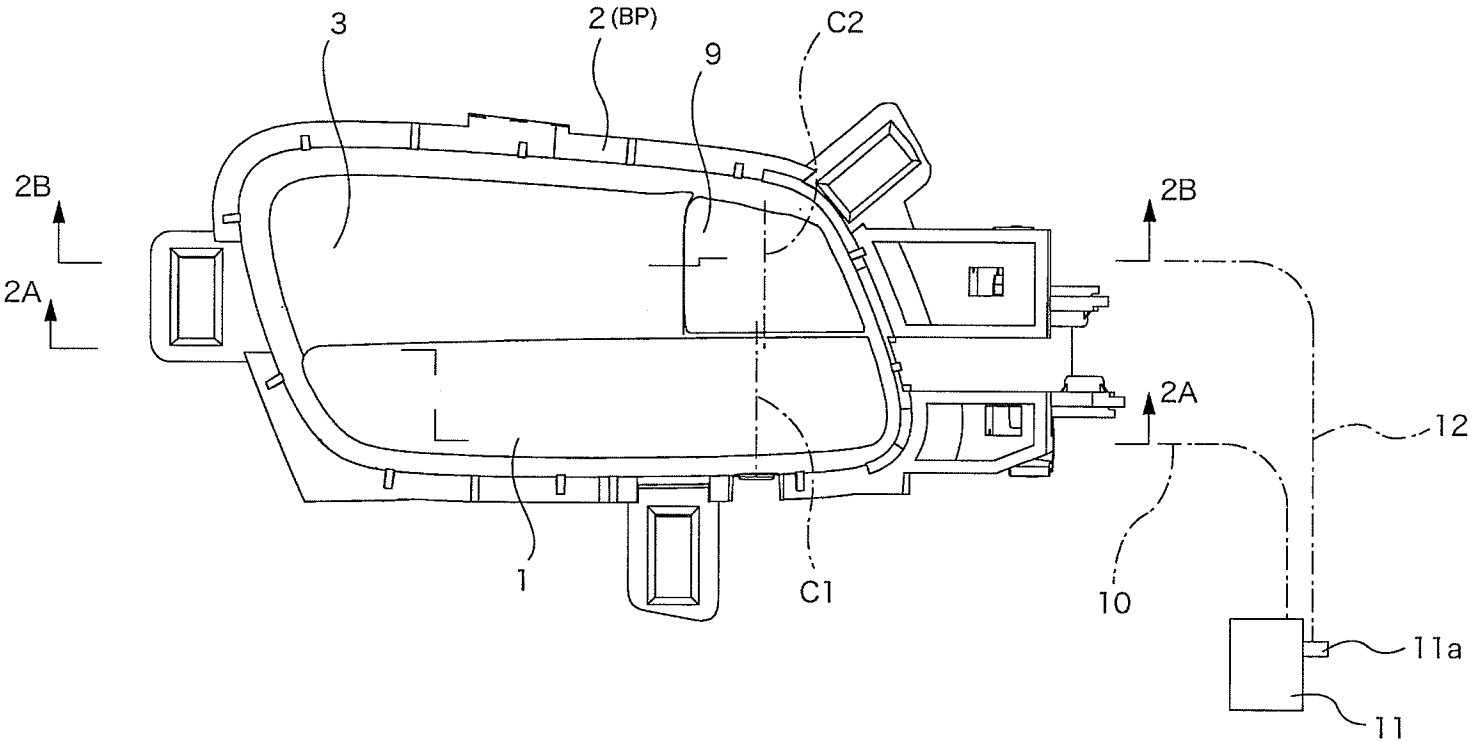
FIG. 1 is a front view showing an inside handle device.

Hereinafter, an exemplary embodiment of the present invention will be described with reference to the drawings. Here, the exemplary embodiment is only an example and not intended to limit the invention. It should be noted that all the features or their combinations described in the exemplary embodiment are not necessarily essential to the invention.

As shown in FIGS. 1 to 5(*d*), an inside handle device of the exemplary embodiment is formed by connecting an operation handle 1 and a locking lever 9 to a handle base 2 as a base part BP. The operation handle 1 is rotatable around a handle rotation center axis (C1) between an initial rotation position indicated by a solid line in FIG. 2(*a*) and an operational rotation position indicated by a dashed line in FIG. 2(*a*) and connected to a lock device 11 via a cable device 10.

The cable device 10 is formed by slidably inserting an inner cable 10*b* into an outer case 10*a* having one end connected to the handle base 2. As the operation handle 1 is rotationally operated to the operational rotation position, an operating force is transmitted to the lock device 11 via the inner cable 10 connected to the operation handle 1 and therefore a lock state of a door is released.

Figure 2A:
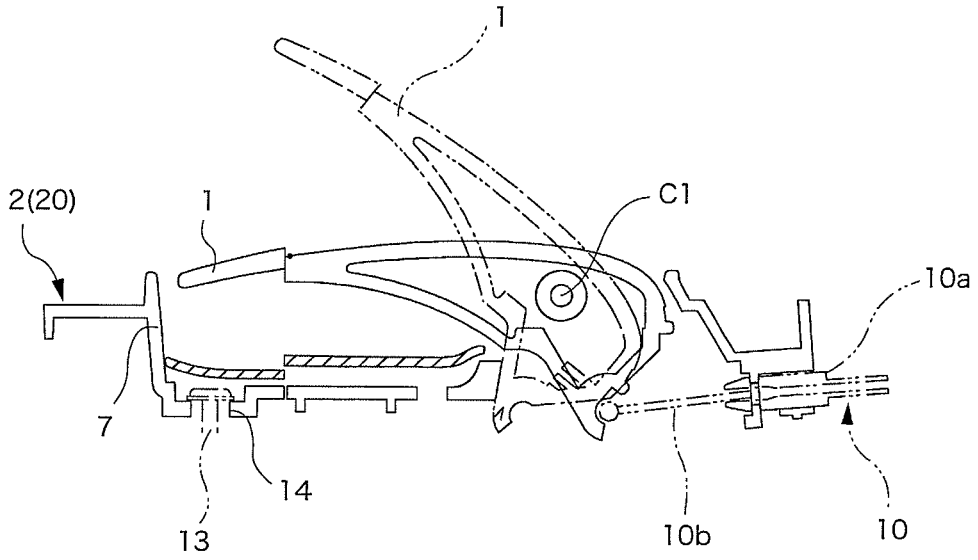
FIG. 2(*a*) is a sectional view taken along a line 2A-2A in FIG. 1 and FIG. 2(*b*) is a sectional view taken along a line 2B-2B in FIG. 1.
Figure 2B:
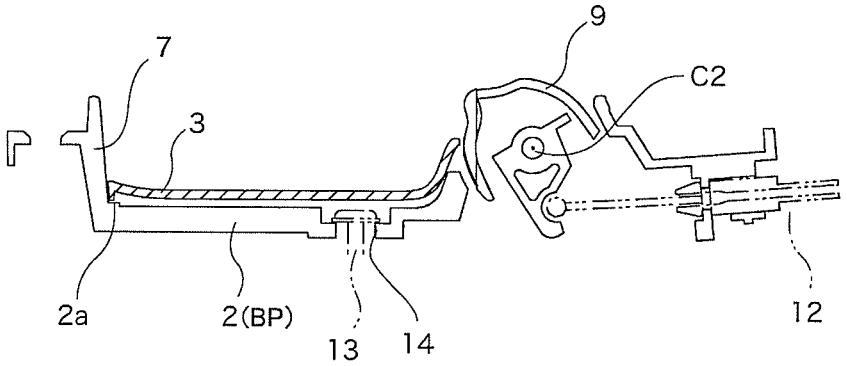

Further, as shown in FIG. 2(*b*), the locking lever 9 can be operated to rotate around a lever rotation center axis (C2). As the locking lever 9 is operated to rotate in a clockwise direction by a predetermined angle from the locked rotation position shown, a cancellation part 11*a* of the door-lock device 11 is operated via a cable device 12 connected to the locking lever 9 and then the operation of the door-lock device 11 by the operation handle 1 is restricted.

As shown in FIGS. 2(*a*) to 3, the inside handle device is fixed to a door panel (not shown) by fixing the handle base 2 to the door panel. The handle base 2 is provided with a through hole 14 through which a fastener 13 used to fix is inserted.

In order to cover a head of the fastener 13, the cover body 3 is mounted to the handle base 2. The handle base 2 includes a frame part 7 to surround the operation handle 1 and the locking lever 9 as described above. The handle base 2 forms a bottom wall surface excluding a rotational base end of the locking lever 9 and the operation handle 1 in a state where the cover body 3 is mounted thereto.

Figure 3:
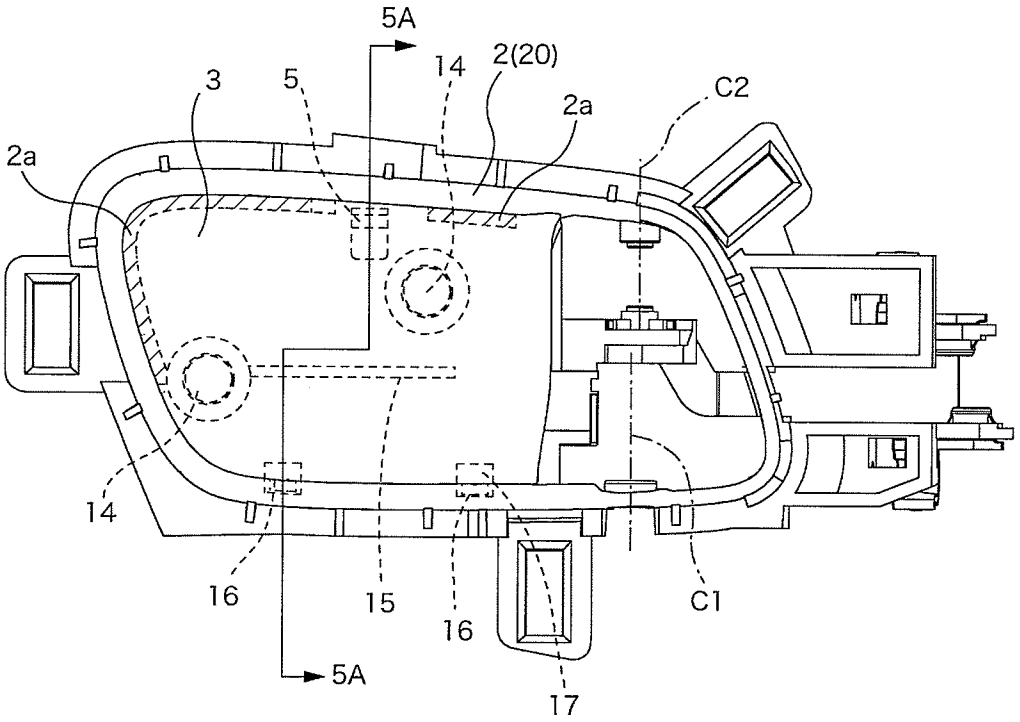
FIG. 3 is a front view showing a cover body in a mounted state.

As shown in FIG. 3, the handle base 2 is provided with a locked part 5 and a lock opening for locking the cover body 3, a bearing plane 2*a* for bearing the cover body 3 and a ridge 15 perpendicular to the handle rotation center of the operation handle 1.

As will be described later, the ridge 15 is intended to provide a swinging center of the cover body 3 and a swinging space 8 of the cover body 3. The bearing plane 2*a* is arranged only at a region where the locked part 5 is provided across the ridge 15, in order not to interfere with the swinging operation of the cover body 3.

Figure 4A:
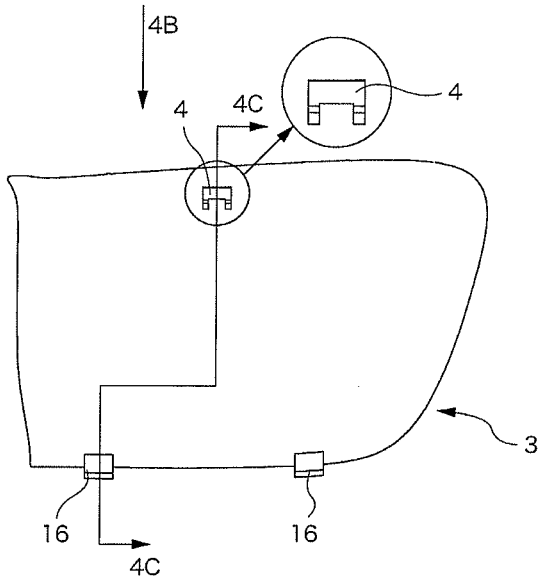
FIG. 4(*a*) is a rear view of the cover body.
Figure 4B:
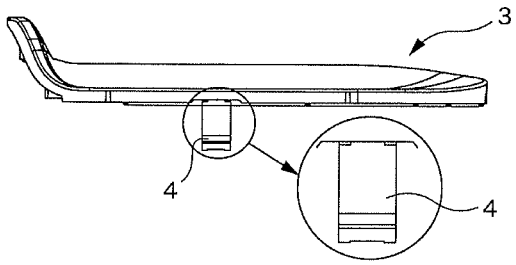
Figure 4C:
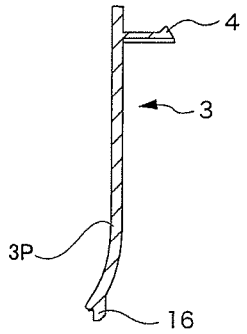
Figure 5A:
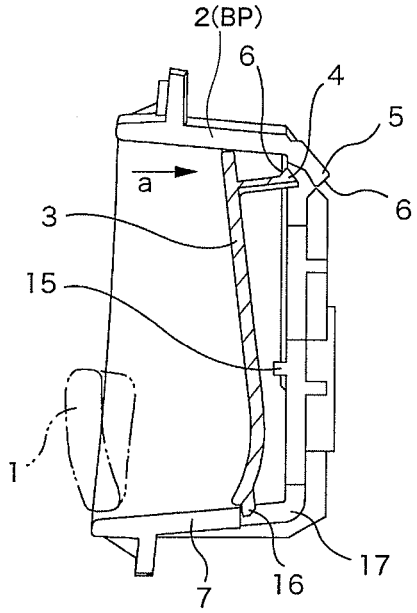
FIG. 5(*a*) to FIG. 5(*d*) are sectional views taken along a line 5A-5A in FIG. 3.
Figure 5B:
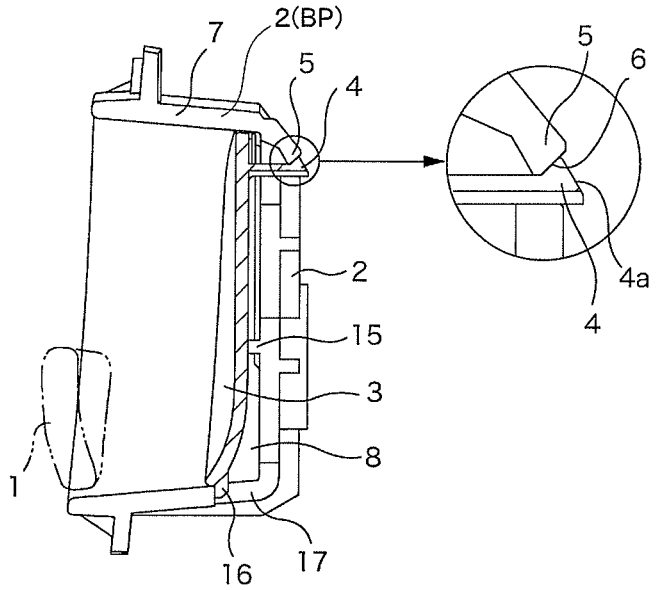
Figure 5C:
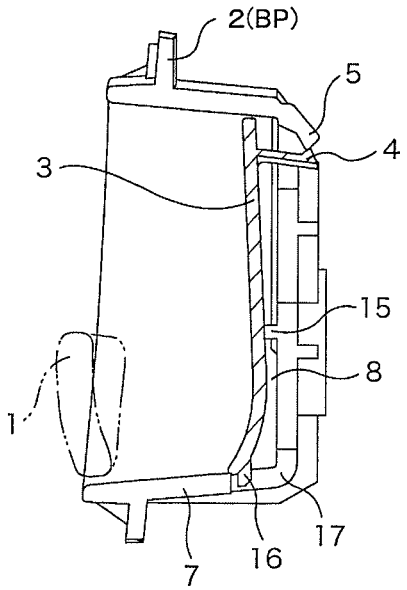
Figure 5D:
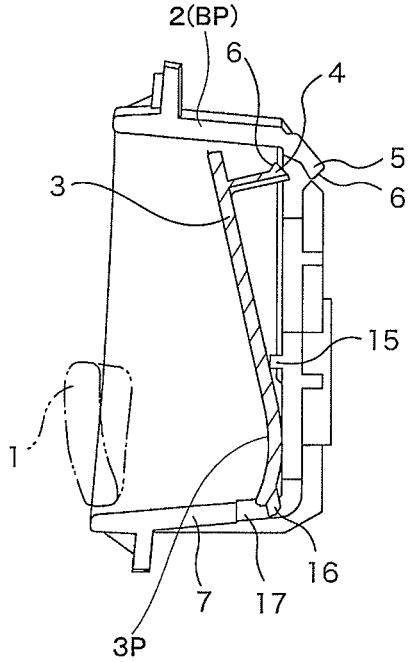

As shown in FIGS. 4(*a*) to 4(*c*), the cover body 3 is formed in a plate shape. One side marginal part of the cover body along the operation handle 1 is provided with two locking protrusions 16 and a marginal part thereof facing these protrusions is provided with one claw-shaped locking part 4. The cover body 3 is mounted to the handle base 2 by pushing the marginal part of the cover body on which the locking part 4 is formed, as indicated by an arrow "a" in FIG. 5(*a*), in a state where the locking protrusions 16 are locked to an upper edge of the locking opening 17 provided at a lower end of the frame part 7 of the handle base 2.

When the pushing operation is performed, an inner wall surface of the frame part 7 of the handle base 2 guides a peripheral edge of the cover body 3 to lead the locking part 4 to the locked part 5 and the locking part 4 led to the locked part 5 is once elastically deformed to avoid the peripheral edge part of the locked part 5 and then returns to an original shape when facing the locked part 5. In this way, a locked state is achieved.

In a mounted state where the locking of the locking part 4 has been completed, the cover body 3 covers the head of the above-described fastener 13 to prevent exposure to the outside, as shown in FIG. 1.

Separation of the inside handle device from this state is performed once by separating the cover body 3 and the above-described ridge 15 is provided in the handle base 2 in order to facilitate the separation. As shown in FIG. 5(*b*), the ridge 15 is formed with a height dimension to come into contact with the rear surface of the cover body 3 in a state where the cover body 3 is mounted. The ridge 15 provides the swinging space 8 of the cover body 3 when the locking of the locking part 4 is released.

Further, as shown in FIG. 5(*b*), the locking part 4 of the cover body 3 is provided with a mounting inclined surface 4*a*. During the pushing operation of the cover body 3, the mounting inclined surface 4*a* is brought into contact with the locked part 5 to generate a reaction force directed inward (to opposite edge) to the locking part 4. The locking part 4 and the locked part 5 are provided with an inclined surface part 6 to generate a component force in an unlocking direction to the locking part 4 when a swinging force is applied in a counter-clockwise direction in FIG. 5(*b*).

Accordingly, in the exemplary embodiment, when a pushing operation force is applied to a marginal part (the pushing operation part 3P) on the side where the locking protrusions 16 of the cover body 3 in the mounted state are disposed, a swinging force in a counter-clockwise direction having a contact part with the ridge 15 as a swinging center occurs in the cover body 3. As described above, the component force in the unlocking direction occurs in the inclined surface part 6 of the locking part 4 by the swinging force. Then, as shown in FIG. 5(*c*), the locking part 4 is elastically deflexed and thus the locking of the locking part 4 and the locked part 5 is released. In this way, the cover body 3 can be detached from the handle base 2, as shown in FIG. 5(*d*).

The pushing operation force required for releasing the mounting of the cover body 3 is properly determined in consideration of an incline angle of the inclined surface part 6, rigidity of the locking part 4 and a gap between the ridge 15 and a pushing operation side end edge. Further, the pushing operation force is set to a magnitude such that the locking of the locking part 4 is not released simply by an erroneous operation.

Further, as shown in FIGS. 1 and 3, the pushing operation part 3P is set at a side where the pushing operation part is covered with the operation handle 1 and is not exposed to the outside in a normal state, so that the detachment of the cover due to a prank is prevented as much as possible.

In the foregoing description, the inside handle device has a configuration that the handle base 2 is an interior surface forming member 20 for providing an external surface of a panel body in a mounted region of the operation handle 1 and the head of the fastener 12 for fixing the handle base 2 to the door panel is covered with the cover body 3 mounted to the interior surface forming member 20. Meanwhile, as shown in FIG. 6, in a case where a door trim 21 is configured as the interior surface forming member 20, the cover body is mounted to the door trim 21.

Figure 6A:
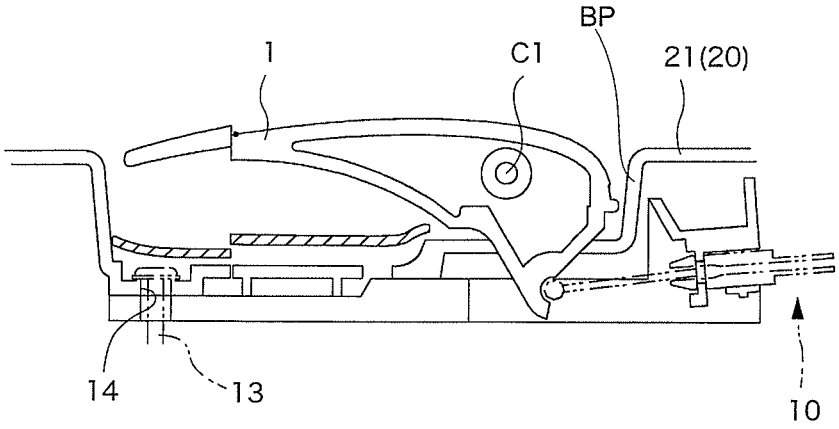
FIGS. 6(*a*) and 6(*b*) are views showing a fixing structure of the inside handle device in which the cover body is mounted to a door trim.
Figure 6B:
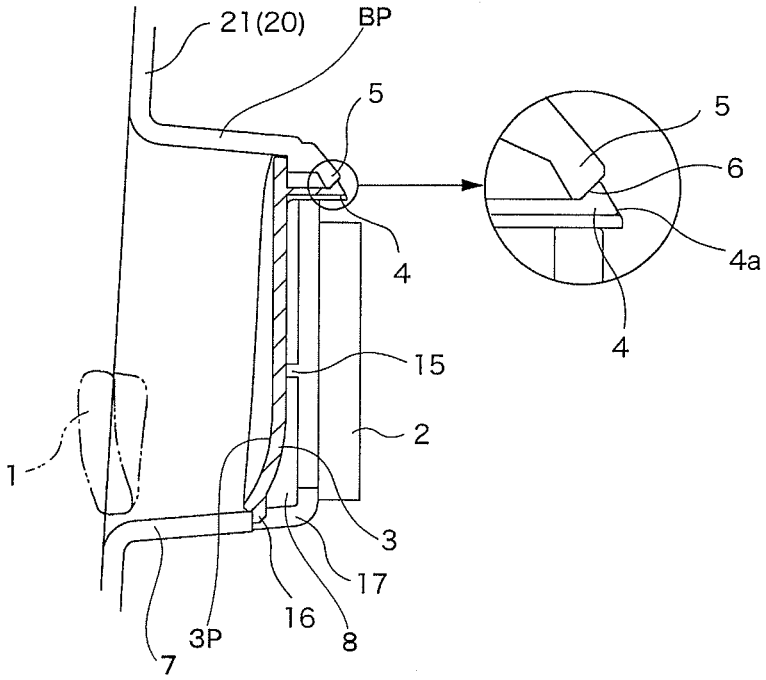
Figure 7:
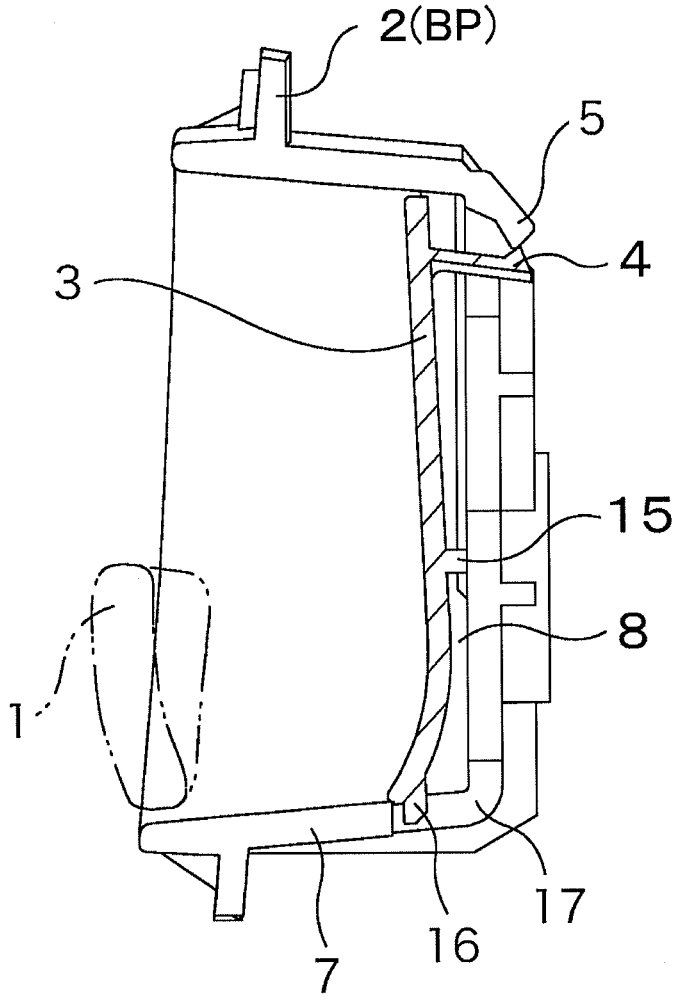
FIG. 7 is an alternate embodiment corresponding to FIG. 5(*c*).

That is, in the structure shown in FIG. 6, the handle base 2 is covered with the door trim 21 and a design surface in the mounted region of the operation handle 1 is configured by the door trim 21. Fixing of the inside handle device is performed by fastening both the door trim 21 and the handle base 2 to the panel using the fastener 13. The locked part 5, the locking opening 17 and the ridge 15 or the like are formed in the door trim 21 as the interior surface forming member 20 and the cover body 3 is connected to the door trim 21 as the base part BP.

Further, although the door trim 21 and the handle base 2 are fastened to the panel by a single fastener 13 in this fixing structure, the fastening between the door trim 21 and the handle base and the fastening between the handle base 2 and the panel may be performed by separate fasteners, respectively.

In FIG. 6, the same or similar components as in the structure of FIGS. 1 to 5(*d*) are denoted by the same or similar reference numerals, and a duplicated description thereof will be omitted.

According to the exemplary embodiment, the door-inside-handle device includes the base part BP (the handle base 2, the door trim 21) and the cover body 3 which is removably mounted to the base part BP and covers the fixing part of the base part BP to the door panel. The swinging space (8) is formed between the cover body 3 and the handle base 2 when the cover body 3 is in the mounted position. By locking the locking part 4 formed on a side edge of the cover body 3 and the locked part 5 of the handle base 2 to each other while elastically deforming either or both the locking part 4 and the locked part 5, the swinging operation is prohibited and the mounted state is maintained.

The inclined surface part 6 is formed between the locking part 4 and the locked part 5 and intended to generate a component force in an unlocking direction to the locking part 4 or the locked part 5 by applying a swinging operation force to the cover body 3. The component force in the unlocking direction occurs in the locking part 4 or the locked part 5 by applying a pushing force directed inward the base part BP to one side edge of the cover body 3.

Accordingly, when the magnitude of the component force by the inclined surface part 6 and the locking force in the locking part 4 and the locked part 5 are properly set, it is possible to detach the cover body 3 simply by providing the pushing operation force to the side edge of the cover body 3. As a result, a special tool is not required and therefore the detaching operability is improved.

The cover body 3 in the mounted state covers substantially the entire base part BP and is formed as an escutcheon to determine a design exterior of the inside handle device. Alternatively, the cover body 3 may be mounted to a bottom wall of the base part BP including the frame part 7 to accommodate the operation handle 1 as the design exterior surface, thereby covering only a region near the fixed part.

In addition to providing a special part (for example, the ridge 15 formed in the base part BP or the cover body 3) set for forming a swinging center, the swinging center of the cover body 3 in a mounted posture may be configured as a result of the contact state or the like without forming the special part.

The locking part 4 may be provided on a marginal part intersecting a swinging center axis, in addition to a marginal part along the swinging center axis. Further, the swinging restriction may be performed only by the locking of the locking part 4 and the locked part 5 or one swinging end may be determined by using a side edge as a contact edge with the base part BP.

Further, when the locking part 4 is formed to protrude from the rear surface of the cover body 3, a locking region between the locking part 4 and the locked part 5 does not appear on the surface and therefore it is possible to improve an outer appearance.

Further, when the pushing operation part 3P of the cover body 3 is disposed at a position where the pushing operation part is covered with the operation handle 1 in an initial rotation position, it is possible to reduce the possibility that the pushing operation part 3P is erroneously pushed and the cover body 3 is detached.

Further, the cover body 3 may be mounted to the handle base 2 or may be mounted to the interior surface forming member 20 (such as the door trim 21) which is used for forming the interior (an exterior design surface) of the door body in the mounted position of the operation handle 1.

According to the above-described exemplary embodiment, since a tool is not required in the detaching operation of the cover body, it is possible to improve the detaching operability.

DESCRIPTION OF REFERENCE NUMERALS

1 OPERATION HANDLE
2 HANDLE BASE
3 COVER BODY
3P PUSHING OPERATION PART
4 LOCKING PART
5 LOCKED PART
6 INCLINED SURFACE PART
7 FRAME PART
8 SWINGING SPACE
20 INTERIOR SURFACE FORMING MEMBER
21 DOOR TRIM
BP BASE PART

The invention claimed is:

1. An inside-door handle device for a vehicle comprising: a base part; and a cover body which is removably mounted to the base part and which covers a connection section of the base part, connected to a door of the vehicle, in a mounted position in which the cover body is mounted to the base part, wherein a swinging space is provided inside of the base part and between the base part and the cover body when the cover body is in the mounted position, wherein the cover body has a locking part, the base part has a locked part, and a swinging of the cover body relative to the base part is restricted by a resilient locking between the locking part and the locked part so that the cover body is held in the mounted position, wherein an inclined surface part is formed on at least one of the locking part and the locked part, and wherein a force in an unlocking direction is generated by the inclined surface part when the cover body is swung relative to the base part into the swinging space by a pushing operation on the cover body, and therefore the resilient locking between the locking part and the locked part is released so that the cover body is detachable from the base part.

2. The inside-door-handle device for the vehicle according to claim 1, wherein the base part includes a frame part having a depth to accommodate an operation handle, and wherein the cover body is attached to a bottom wall of the base part.

3. The inside-door-handle device for the vehicle according to claim 1, wherein the cover body has one side edge that defines one swinging end by contacting with the base part, and the other side edge formed with the locking part that restricts the swinging in a detachment direction.

4. The inside-door-handle device for the vehicle according to claim 1, wherein the locking part is formed to protrude from a rear surface of the cover body.

5. The inside-door-handle device for the vehicle according to claim 4, wherein an operation handle is arranged along a side edge of the cover body, and wherein a pushing operation part of the cover body is disposed at a position where the pushing operation part is covered with the operation handle in an initial rotation position.

6. The inside-door-handle device for the vehicle according to claim 2, wherein a ridge is provided at a bottom wall of the base part or a rear surface of the cover body, the ridge extending along a longitudinal direction of the operation handle and protruding in a depth direction, wherein a pushing operation part is provided at a part of the cover body corresponding to the swinging space, wherein the ridge is located between the pushing operation part and the locking part, and wherein the cover body is swung about the ridge as the pushing operation part is pushed toward the swinging space.

7. The inside-door-handle device for the vehicle according to claim 6, wherein the pushing operation part of the cover body is disposed at a position where the pushing operation part is covered with the operation handle in an initial rotation position.

8. The inside-door-handle device for the vehicle according to claim 1, wherein the base part comprises a handle base to which an operation handle is connected.

9. The inside-door-handle device for the vehicle according to claim 1, wherein the base part is formed at a door trim.

* * * * *